US012781455B2

(12) United States Patent
Zhou et al.

(10) Patent No.: US 12,781,455 B2
(45) Date of Patent: Nov. 3, 2026

(54) CONSTRUCTION METHOD FOR RECONSTRUCTING AND EXPANDING SHIP LOCK IN SITU

(71) Applicants: Hunan Water Transport Construction Investment Group Co., Ltd, Changsha (CN); Hunan Navigation Engineering Co., Ltd, Changsha (CN)

(72) Inventors: Qiankai Zhou, Changsha (CN); Ding Zhou, Changsha (CN); Zhiyong Lu, Changsha (CN); Bin Sun, Changsha (CN); Qin Zhou, Changsha (CN); Xiongcai Kang, Changsha (CN); Gang Li, Changsha (CN); Hui Song, Changsha (CN); Wei Yu, Changsha (CN); Fang Liu, Changsha (CN); Yun Zhang, Changsha (CN)

(73) Assignees: Hunan Water Transport Construction Investment Group Co., Ltd, Changsha (CN); Hunan Navigation Engineering Co., Ltd, Changsha (CN)

( * ) Notice: Subject to any disclaimer, the term of this patent is extended or adjusted under 35 U.S.C. 154(b) by 0 days.

(21) Appl. No.: 19/293,111

(22) Filed: Aug. 7, 2025

(65) Prior Publication Data

US 2025/0361689 A1 Nov. 27, 2025

Related U.S. Application Data

(63) Continuation of application No. PCT/CN2024/070965, filed on Jan. 5, 2024.

(30) Foreign Application Priority Data

Nov. 9, 2022 (CN) ..... 202211396074.2

(51) Int. Cl.
*E02C 1/00* (2006.01)

(52) U.S. Cl.
CPC ..... *E02C 1/00* (2013.01)

(58) Field of Classification Search
CPC ..... E02C 1/00; E02C 1/04; E02C 1/06; E02C 1/10
See application file for complete search history.

(56) References Cited

U.S. PATENT DOCUMENTS 4,310,769 A * 1/1982 Mazzone ..... F03B 13/06 290/1 R
8,376,657 B2 * 2/2013 Dudding ..... B09B 1/008 405/129.95

(Continued)

FOREIGN PATENT DOCUMENTS

CN 111424627 A 7/2020
CN 112049099 A * 12/2020 ..... E02C 1/00

(Continued)

OTHER PUBLICATIONS

Hua et al.; CN 112049099 A; Machine Translation; All; Dec. 2020 (Year: 2020).*

*Primary Examiner* — Benjamin F Fiorello

(57) ABSTRACT

A construction method for reconstructing and expanding a ship lock in suit is provided. A flood gate in an upper lock head section of a constructed ship lock is used as a water-retaining cofferdam during a construction period. A remaining part of the constructed ship lock is cut off downstream from a target cutting surface located in a lock chamber section of the constructed ship lock, and a new ship lock is constructed downstream. A bank-side pier structure between the upper lock head section of the constructed ship lock and the new ship lock is cut to a first preset elevation, and two water-retaining and seepage control lines are added, and a cutoff buttress is constructed. An upper navigation wall (Continued)

section of the constructed ship lock and the upper lock head section of the constructed ship lock are reconstructed, and another water-retaining and seepage control line is added.

8 Claims, 10 Drawing Sheets

(56) References Cited

U.S. PATENT DOCUMENTS

| | | | | |
|---|---|---|---|---|
| 9,903,082 | B2 * | 2/2018 | Wang | E02B 3/16 |
| 2002/0119010 | A1 * | 8/2002 | Len-Rios | E02C 1/06 405/85 |
| 2008/0038062 | A1 * | 2/2008 | Allonca | E02C 1/06 405/85 |

FOREIGN PATENT DOCUMENTS

| | | | |
|---|---|---|---|
| CN | 113463606 | A | 10/2021 |
| CN | 218479129 | U | 2/2023 |

* cited by examiner

A - A

A - A

B - B

CONSTRUCTION METHOD FOR RECONSTRUCTING AND EXPANDING SHIP LOCK IN SITU

CROSS-REFERENCE TO RELATED APPLICATIONS

The application claims priority to Chinese patent application 2022113960742, filed on Nov. 9, 2022, the entire contents of which are incorporated herein by reference.

TECHNICAL FIELD

The present disclosure relates to the technical field of ship lock engineering, and in particular to a construction method for reconstructing and expanding a ship lock in situ.

BACKGROUND

In recent years, to promote the development of inland navigation industries, a large number of navigation-power junctions have been built in China to upgrade waterway classification standards and enhance navigability conditions. The ship lock, as a shipping navigation structure, is an important part of the navigation-power junction, and its scale directly affects inland navigation. In recent years, with the frequent economic activities between different regions, the shipping freight volume has increased rapidly, the transportation fleet has gradually become larger, the through capacity of the constructed ship locks can no longer meet the demand for rapid increase in traffic volume, making queuing time of ships at the ship lock prolonged and affecting the normal transportation of water and land supplies. Therefore, many ship locks are faced with the problem of reconstruction and expansion. At present, the conventional method is to expand a second-line ship lock beside the existing ship lock. However, the expansion of the second-line ship lock may lead to large floor space, significant capital expenditure, which may even seriously affect riverside traffic management during the construction period. Therefore, it is often necessary to reconstruct on the basis of the existing ship lock, especially in valley of the middle and upper reaches. Due to the restriction of topography and landforms, areas that have little impact during the period of suspension of navigation must be reconstructed and expanded on the basis of the original ship lock.

In the prior art, for the reconstruction and expansion project of the ship lock, the conventional solution is as follows: completing demolition of all the existing ship locks, and then excavating a foundation pit at an adjacent side to construct a new second-line ship lock; during the construction period, backfilling the constructed ship lock as a construction cofferdam, and enclosing the foundation pit by earth-rock cofferdams in the upstream and downstream. However, due to topographic limitations, it is often impossible to arrange the second-line ship lock, or even if an available space exists, substantial expansion of land acquisition area is also required, leading to the increase of project investment.

In view of this, it is necessary to put forward a construction method for reconstructing and expanding a ship lock in situ to solve or at least alleviate the foregoing defects.

SUMMARY

A main objective of the present disclosure is to provide a construction method for reconstructing and expanding a ship lock in situ, thereby solving the problems in the prior art that, due to terrain constraints, it is often impossible to arrange the second-line ship lock, or even if an available space exists, substantial expansion of land acquisition area is also required, leading to the increase of project investment.

To achieve the foregoing objective, the present disclosure provides a construction method for reconstructing and expanding a ship lock in situ, including the following steps:

S1, taking a flood gate in an upper lock head section of a constructed ship lock as a water-retaining cofferdam during a construction period, cutting off a remaining part of the constructed ship lock downstream from a target cutting surface located in a lock chamber section of the constructed ship lock, where the target cutting surface is at a preset distance from the flood gate, and the target cutting surface is perpendicular to an extension direction of the constructed ship lock;

S2, constructing a new ship lock downstream from the target cutting surface, where an upper lock head section of the new ship lock is connected to the target cutting surface, and an entrance width of the new ship lock is larger than that of the constructed ship lock;

S3, cutting a bank-side pier structure between the upper lock head section of the constructed ship lock and the upper lock head section of the new ship lock to a first preset elevation, where a difference between a lowest design navigable water level of the constructed ship lock and the first preset elevation meets a navigable requirement;

S4, adding a first water-retaining and seepage control line and a second water-retaining and seepage control line, where the first water-retaining and seepage control line corresponds to the upper lock head section of the constructed ship lock, the second water-retaining and seepage control line is located between the upper lock head section of the constructed ship lock and the upper lock head section of the new ship lock, an upstream end of the first water-retaining and seepage control line is connected to an original water-retaining and seepage control line of the constructed ship lock, and an upstream end of the second water-retaining and seepage control line is connected to a downstream end of the first water-retaining and seepage control line;

S5, constructing a cutoff buttress at a position corresponding to the upper lock head section of the new ship lock, and reconstructing an upper navigation wall section and the upper lock head section of the constructed ship lock to enable a navigable width of the constructed ship lock to match the entrance width of the new ship lock, where the cutoff buttress is inserted into a bank-side soil body from the upper lock head section of the new ship lock in a direction perpendicular to a water flow; and

S6, adding a third water-retaining and seepage control line, where the third water-retaining and seepage control line corresponds to the upper lock head section of the new ship lock and the cutoff buttress and extends in the direction perpendicular to the water flow, a riverside end of the third water-retaining and seepage control line is connected to a downstream end of the second water-retaining and seepage control line, and a bank-side end of the third water-retaining and seepage control line is located in the bank-side soil body.

Preferably, the method further includes the following steps between step S3 and step S4:

S31: reinforcing a river-side pier structure between the upper lock head section of the constructed ship lock and the upper lock head section of the new ship lock.

Preferably, "reinforcing a river-side pier structure between the upper lock head section of the constructed ship lock and the upper lock head section of the new ship lock" in step S31 specifically includes the following steps:

S311: constructing a reinforcing retaining wall on an inner side of the river-side pier structure, wherein the bottom of the reinforcing retaining wall is fastened to a bottom plate of the lock chamber section of the constructed ship lock by implanting an anchoring steel bar, a sidewall of the reinforcing retaining wall is fastened to the river-side pier structure by implanting the anchoring steel bar, and the second water-retaining and seepage control line is arranged on an inner side of the reinforcing retaining wall.

Preferably, after step S311, the method further includes the following steps:

S312: implanting a prestressed anchor cable into the reinforcing retaining wall, where the prestressed anchor cable penetrates through the reinforcing retaining wall downwards from the top thereof and is fastened to the bottom plate of the lock chamber section of the constructed ship lock.

Preferably, "reconstructing an upper navigation wall section and the upper lock head section of the constructed ship lock" in step S5 specifically includes:

S51: sequentially cutting off the upper lock head section of the constructed ship lock and a bank-side part structure of the upper navigation wall section of the constructed ship lock upstream along an inner wall of the bank-side pier structure, thereby enabling the navigable width of the constructed ship lock to match the entrance width of the new ship lock; and S52: cutting off a river-side part structure of the upper lock head section of the constructed ship lock upstream along the inner wall of the river-side pier structure, thereby connecting the upper lock head section of the constructed ship lock to the reinforcing retaining wall.

Preferably, the method further includes the following steps between step S3 and S4:

S32: replacing and filling an internal backfill between the bank-side pier structure and a river embankment to the first preset elevation with C20 concrete.

Preferably, a thickness of the reinforcing retaining wall ranges from 2.8 m to 3.2 m, and a height of the reinforcing retaining wall is 4-6 m higher than the top of the river-side pier structure.

Preferably, after step S3, the method further includes the following steps:

pouring the bank-side pier structure to a second preset elevation after implanting the steel bar into the top thereof, thereby leveling a top surface of the bank-side pier structure.

Compared with the prior art, the present disclosure has beneficial effects as follows:

The present disclosure provides a construction method for reconstructing and expanding a ship lock in suit, a flood gate in an upper lock head section of a constructed ship lock is used as a water-retaining cofferdam during a construction period. A remaining part of the constructed ship lock is cut off downstream from a target cutting surface located in a lock chamber section of the constructed ship lock, and a new ship lock is constructed downstream. A bank-side pier structure between the upper lock head section of the constructed ship lock and an upper lock head section of the new ship lock is cut to a first preset elevation, a first water-retaining and seepage control line and a second water-retaining and seepage control line are added, and a cutoff buttress is constructed. An upper navigation wall section of the constructed ship lock and the upper lock head section of the constructed ship lock are reconstructed, and a third water-retaining and seepage control line is added.

On the premise of not damaging an original water-retaining line building during the construction period, firstly, a new ship lock is constructed downstream as a new ship lock water-retaining line building, a constructed lock wall structure is fully utilized, and a water-retaining line of a ship lock junction is innovatively moved down by cutting the bank-side pier structure and adding the first water-retaining and seepage control line, the second water-retaining and seepage control line and the third water-retaining and seepage control line, thereby ensuring that the normal operation of the constructed junction will not be affected during the construction period. Secondly, by newly constructing the water-retaining line downstream, inertial thinking that a large-scale earth-rock cofferdam project needs to be constructed upstream to reconstruct an existing water-retaining line building is skillfully avoided, thereby ensuring safety during the construction period of the project reconstruction, and greatly saving the project cost. The reconstruction and expansion on the basis of the original ship lock do not require large-scale land acquisition on the side, which may be the only scheme in a canyon area, and can effectively save land and project investment. It should be noted that the scheme provided by the present disclosure is applicable to all future technical solutions for reconstructing and expanding a ship lock in situ, and can provide reference ideas for the industry.

BRIEF DESCRIPTION OF THE DRAWINGS

To describe the technical solutions in the embodiments of the present disclosure or in the prior art more clearly, the following briefly introduces the accompanying drawings required for describing the embodiments. Apparently, the accompanying drawings in the following description show merely some embodiments of the present disclosure, and a person of ordinary skill in the art may still derive other drawings from these accompanying drawings without creative efforts.

Figure 1:
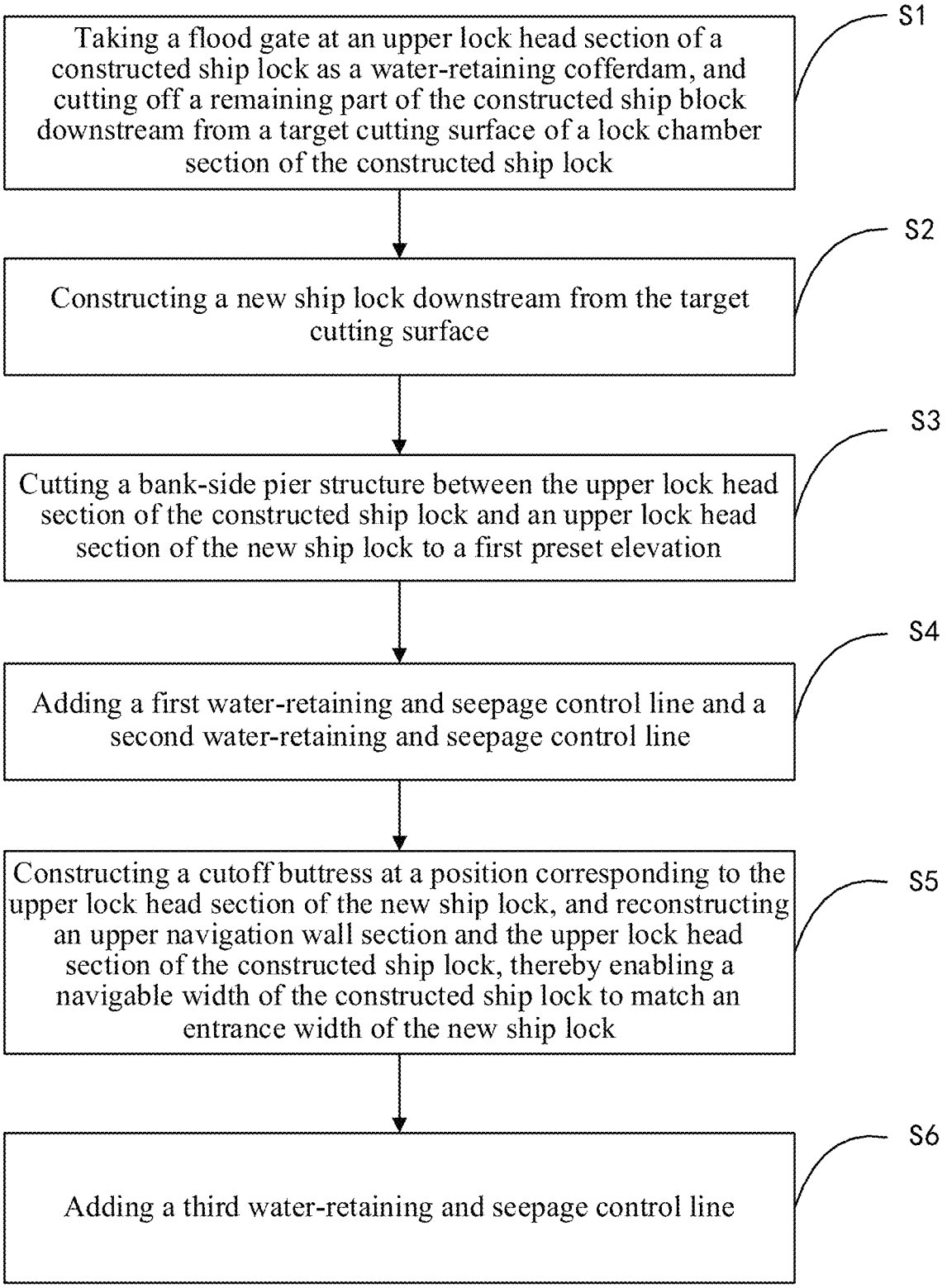
FIG. 1 is a flowchart according to an embodiment of the present disclosure.
Figure 2:
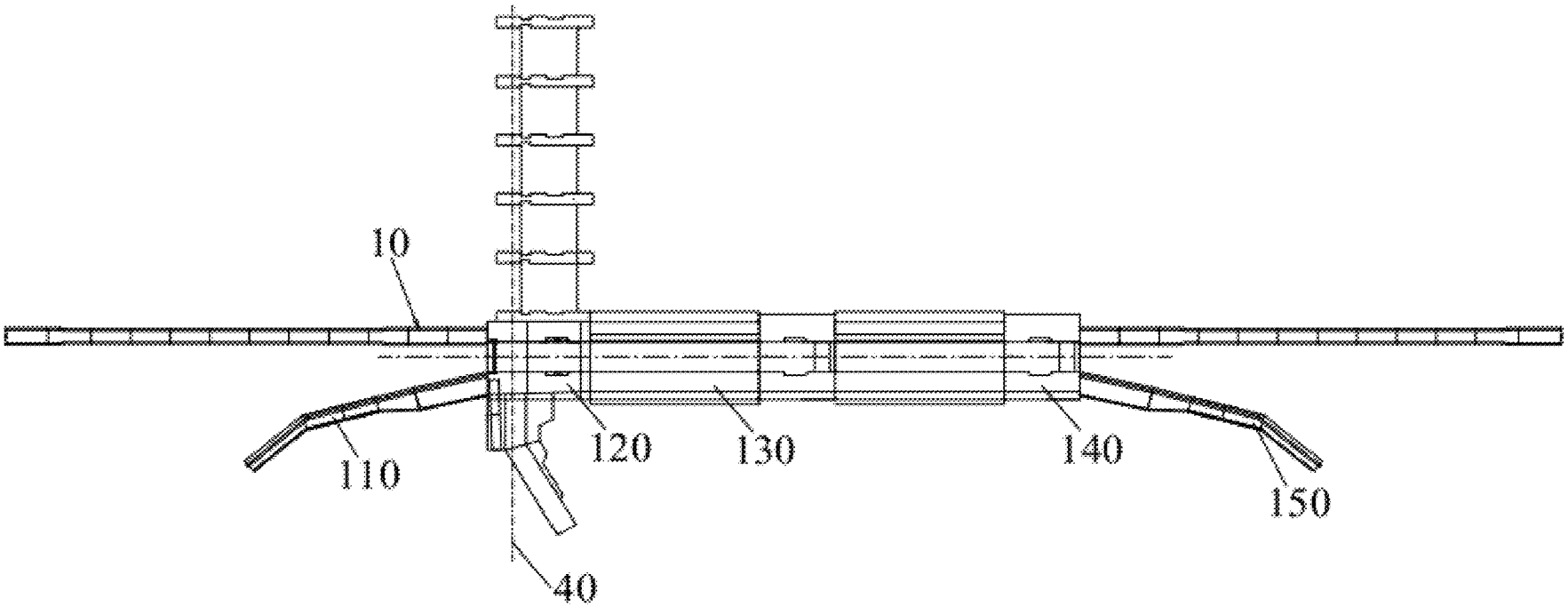
FIG. 2 is a diagram of a structure of a constructed ship lock in the prior art.
Figure 3:
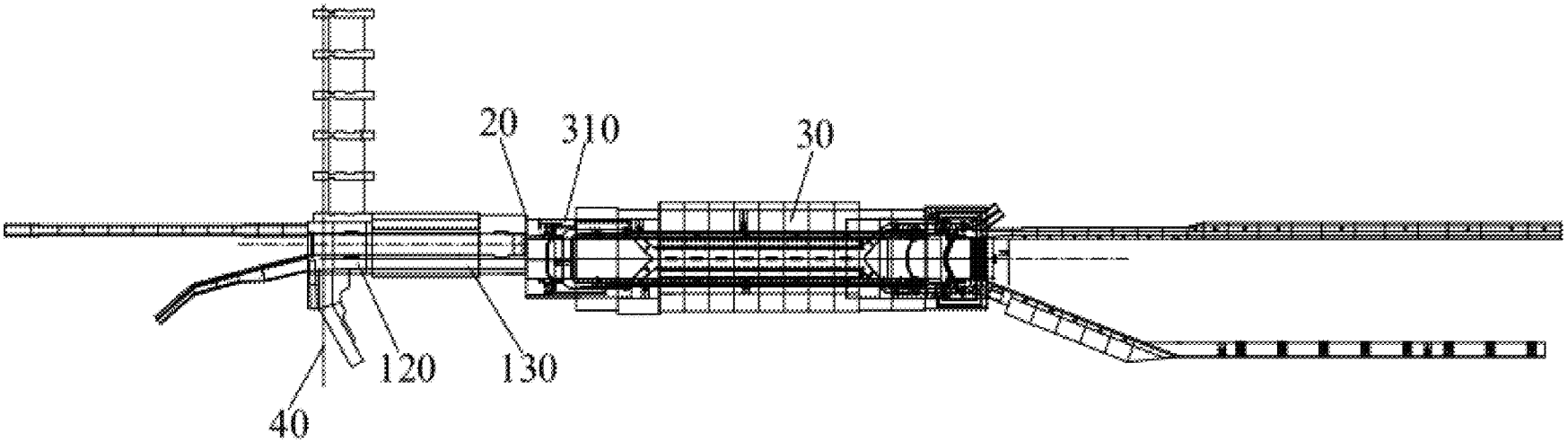
FIG. 3 is a diagram of a structure after a new ship lock is constructed according to an embodiment of the present disclosure.
Figure 4:
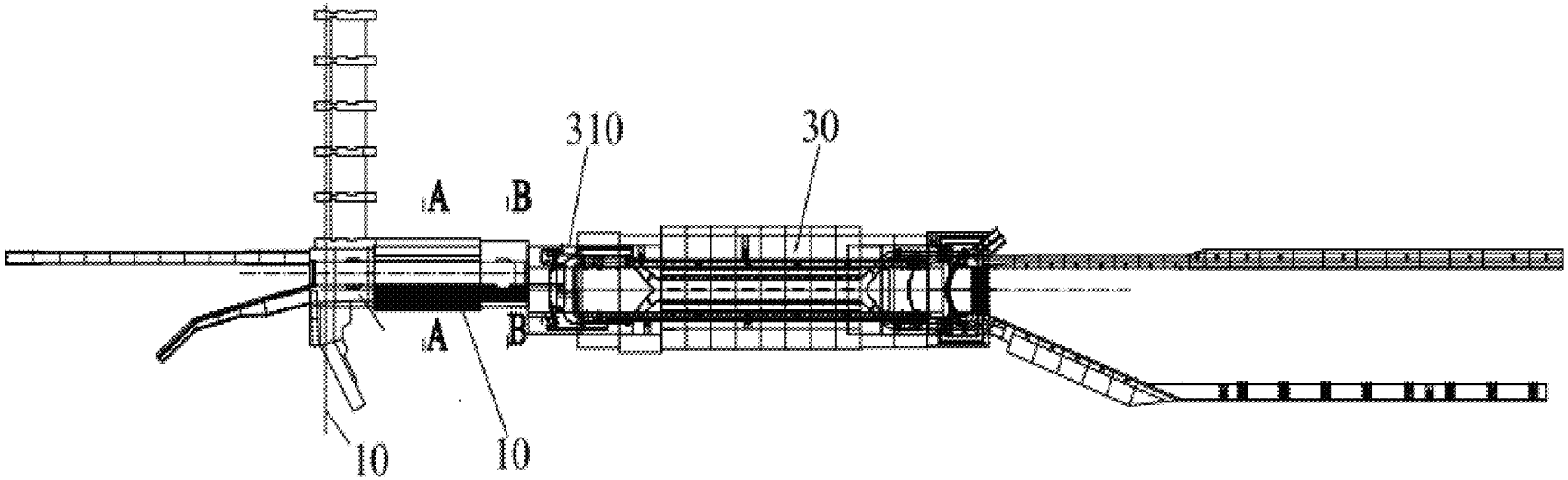
FIG. 4 is a diagram of a structure after a bank-side pier structure is cut according to an embodiment of the present disclosure.

The implementation of objectives, functional features and advantages of the present disclosure will be further described with reference to embodiments and accompanying drawings.

10—constructed ship lock; 111—constructed upstream navigation wall section; 120—upper lock head section of constructed ship lock; 130—lock chamber section of constructed ship lock; 131—bottom plate; 140—lower lock head section of constructed ship lock; 150—lower navigation wall section of constructed ship lock; 160—reinforcing retaining wall; 161—anchoring steel bar; 162—prestressed anchor cable; 170—river-side pier structure; 180—bank-side pier structure; 20—target cutting surface; 30—new ship lock; 310—upper lock head section of new ship lock; 320—cutoff buttress; 40—original water-retaining and seepage control line; 420—first water-retaining and seepage control line; 430—second water-retaining and seepage control line; 440—third water-retaining and seepage control line; 50—C20 concrete.

DETAILED DESCRIPTION OF THE EMBODIMENTS

It should be understood that specific embodiments described here serve merely to explain the present disclosure rather than limiting.

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by a person of ordinary skill in the art based on the embodiments of the present disclosure without creative efforts shall fall within the scope of protection of the present disclosure.

It should be noted that all directional indications (such as up, down, left, right, front, back) in the embodiment of the present disclosure are merely used to explain a relative position relationship and movement situation among components in a certain posture (as shown in the accompanying figure), and if the certain posture changes, the directional indication will also change accordingly.

In addition, the descriptions of "first" and "second" in the present disclosure are only used for descriptive purposes, and cannot be construed as indicating or implying relative importance or implying a number of the indicated technical features. Therefore, the features defined as "first" and "second" can explicitly or implicitly include at least one of these features. In addition, the technical solutions of various embodiments can be combined with each other, but they must be based on the implementation of those of ordinary skill in the art. When the combination of technical solutions is contradictory or impossible, it should be considered that the combination of technical solutions does not exist and is not within the scope of protection claimed by the present disclosure.

Please referring to FIG. 1 to FIG. 10, an embodiment of the present disclosure provides a construction method for reconstructing and expanding a ship lock in situ, including the following steps.

S1: A flood gate in an upper lock head section 120 of a constructed ship lock is used as a water-retaining cofferdam during a construction period, a remaining part of the constructed ship lock 10 is cut off downstream from a target cutting surface 20 located in a lock chamber section 130 of the constructed ship lock, where the target cutting surface 20 is at a preset distance from the flood gate, and the target cutting surface 20 is perpendicular to an extension direction of the constructed ship lock 10.

To facilitate those skilled in the part to fully understand the technical solution of the present disclosure, partial key nouns are explained at present. The constructed ship lock 10 in the present disclosure refers to a ship lock constructed in advance, which is also a main object to be reconstructed and expanded. The new ship lock 30 refers to a ship lock part new ship lock based on the constructed ship lock 10. For example, the constructed ship lock 10 includes an upper navigation wall section, an upper lock head section, a lock chamber section, a lower lock head section and a lower navigation wall section which are sequentially connected from upstream to downstream. The new ship lock 30 includes an upper lock head section, a lock chamber section, a lower lock head section and a lower navigation wall section. The constructed ship lock 10 after reconstruction and expansion is equivalent to the upper navigation wall section of the new ship lock 30.

Specifically, when reconstructing and expanding the constructed ship lock 10, a flood gate in the upper lock head section 120 of the constructed ship lock is fully utilized as a water-retaining cofferdam during the construction period. During construction, the flood gate of at the upper lock head is temporarily closed to block upstream water, thereby ensuring the normal construction of the downstream, and avoiding the inertia thinking that the large-scale earth-rock cofferdam project needs to be constructed in the upstream in the conventional construction scheme.

According to the present disclosure, the remaining part of the constructed ship lock 10 is cut off downstream from the target cutting surface 20 in the lock chamber section 130 of the constructed ship lock. It should be noted that the selection of the target cutting surface 20 is related to the number of stages of the constructed ship lock 10 and actual needs, and the selection of the target cutting surface 20 should not be too close to the upper lock head section 120 of the constructed ship lock, otherwise the structure of the upper lock head section 120 of the constructed ship lock will be greatly affected. On the contrary, if the target cutting surface is far from the upper lock head section 120 of the constructed ship lock, a length of a key water-retaining and seepage control line in a subsequent new curtain will be too long, resulting in project waste. In other words, the preset distance from the target cutting surface 20 to the flood gate in the upper lock head needs to be constant, which cannot be too long or too short.

As a preferred example, with the constructed ship lock 10 as a secondary ship lock as an example, a position of the target cutting surface 20 is located at an interface between a middle lock head of the constructed ship lock 10 and a secondary lock chamber section. During actual cutting, a structural part of the constructed ship lock 10 is cut off/demolished downstream from the target cutting surface, that is, the secondary lock chamber section, the lower lock head and the lower navigation wall section are cut off in sequence, thereby facilitating a construction of a new ship lock 30 with a larger shipping freight volume at a downstream position of the target cutting surface 20.

Further, the target cutting surface 20 may be perpendicular to an extension direction of the constructed ship lock 10, or the target cutting surface 20 may be appropriately inclined, as long as a corresponding upper lock head section 310 of the new ship lock is connected to the target cutting surface 20, it can be used as the target cutting surface 20 in the present disclosure.

S2: A new ship lock 30 is constructed downstream from the target cutting surface 20, where an upper lock head section 310 of the new ship lock is connected to the target cutting surface 20, and an entrance width of the new ship lock 30 is larger than that of the constructed ship lock 10. It may be understood that the present disclosure aims at reconstructing and expanding in situ or on the basis of the constructed ship lock 10, thereby expanding the shipping freight volume of the ship lock. The new ship lock 30 is constructed downstream from the target cutting surface 20. Preferably, an extension direction of the new ship lock 30 may be set to be in consistent with that of the constructed ship lock 10. It is easy to understand that the upper lock head section 310 of the new ship lock is connected to the target cutting surface 20, that is, a navigable channel of the upper lock head section 310 of the new ship lock is connected to the lock chamber section 130 of the constructed ship lock, where the entrance width of the new ship lock 30 is greater than that of the constructed ship lock 10, that is, the shipping freight volume of the new ship lock 30 is greater than that of the constructed ship lock 10. In addition, a structural form of the new ship lock 30 can be set by the those skilled in the art according to actual needs, such as a new single-stage ship lock, a double-stage ship lock, or a multi-stage ship lock.

S3: A bank-side pier structure 180 between the upper lock head section 120 of the constructed ship lock and the upper lock head section 310 of the new ship lock is cut to a first preset elevation, where a difference between a lowest design navigable water level of the constructed ship lock 10 and the first preset elevation meets a navigable requirement.

It should be noted that by cutting off the bank-side pier structure 180 between the upper lock head section 120 of the constructed ship lock and the upper lock head section 310 of the new ship lock, a navigable space of the constructed ship lock 10 close to the bank side is broadened. It should be noted that to ensure the normal navigable needs, the difference between the lowest design navigable water level of the constructed ship lock 10 and the first preset elevation needs to meet the navigable requirement. Further, a river-side pier structure 170 and the bank-side pier structure 180 need to be illustrated, the river-side pier structure 170/bank-side pier structure 180 includes, but is not limited to, a lock wall of the constructed ship lock 10. As the name implies, the river-side pier structure 170 is a pier structure close to one side of the river, and the bank-side pier structure 180 is a pier structure close to a river embankment/river bank. In an embodiment of the present disclosure, the way of cutting off the bank-side pier structure 180 but reserving the river-side pier structure 170 can implement the expansion from the upper lock head section 120 of the constructed ship lock to the upper lock head section 310 of the new ship lock.

S4: A first water-retaining and seepage control line 420 and a second water-retaining and seepage control line 430 are added, where the first water-retaining and seepage control line 420 corresponds to the upper lock head section 120 of the constructed ship lock, the second water-retaining and seepage control line 430 is located between the upper lock head section 120 of the constructed ship lock and the upper lock head section 310 of the new ship lock, an upstream end of the first water-retaining and seepage control line 420 is connected to an original water-retaining and seepage control line 40 of the constructed ship lock 10, and an upstream end of the second water-retaining and seepage control line 430 is connected to a downstream end of the first water-retaining and seepage control line 420.

It should be understood by those skilled in the art that to fully ensure impervious treatment after the expansion of the constructed ship lock 10, the first water-retaining and seepage control line 420 and the second water-retaining and seepage control line 430 are added, where the first water-retaining and seepage control line 420 corresponds to the upper lock head section 120 of the constructed ship lock, and the second water-retaining and seepage control line corresponds to the lock chamber section 130 of the constructed ship lock, thereby ensuring the impervious effect to the greatest extent. As a specific example, both the first water-retaining and seepage control line 420 and the second water-retaining and seepage control line 430 can be in the form of curtain grouting. The first water-retaining and seepage control line 420 is located at the upper lock head section 120 of the constructed ship lock and extends along the extension direction of the constructed ship lock 10, and the second water-retaining and seepage control line 430 is located between the upper lock head section 120 of the constructed ship lock and the upper lock head section 310 of the new ship lock and extends along the extension direction of the constructed ship lock 10. It can be understood by those skilled in the art the water-retaining and seepage control line is located in the foundation and a part below the foundation. Arranging the water-retaining and seepage control line to correspond to the ship lock structure can ensure the impervious effect to the greatest extent. In addition, it should also be noted that the water-retaining seepage control line generally extends in a direction perpendicular to the water flow along a spillway sluice, and extends into the river embankment/river bank after passing through the upper lock head section 120 of the constructed ship lock in turn. By adding the first water-retaining and seepage control line 420 and the second water-retaining and seepage control line 430, the water-retaining and impervious range of the original water-retaining and seepage control line 40 of the previously constructed ship lock 10 can be moved down to an upstream position of the newly ship lock 30, thereby ensuring that the safety of a constructed junction will not be affected during the construction period.

S5. A cutoff buttress 320 is constructed at a position corresponding to the upper lock head section 310 of the new ship lock, and an upper navigation wall section and the upper lock head 120 of the constructed ship lock 10 are reconstructed to make a navigable width of the constructed ship lock 10 match an entrance width of the new ship lock 30, where the cutoff buttress 320 is inserted into the bank-side soil body from the upper lock head 310 of the new ship lock in the direction perpendicular to the water flow.

It should be noted by those skilled in the art that the cutoff buttress 320 is equivalent to a retaining dam structure of the new ship lock 30, and extends into the river embankment/mountain body from a bank side of the upper lock head section 310 of the new ship lock in the direction perpendicular to the water flow. Constructing the cutoff buttress 320 can stop the water above a riverbed at the upstream of the new ship lock 30. In addition, as can be learned from the foregoing content that, to fully implement the reconstruction and expansion in situ, in this step, the upper navigation wall of the constructed ship lock 10 and the upper lock head section 120 of the constructed ship lock are continuously reconstructed, for example, the upper navigation wall of the constructed ship lock 10 and a part of the upper lock head section 120 of the constructed ship lock are removed upstream along an inner wall/outer wall of the bank-side pier structure 180, thereby achieving the expansion of the upper navigation wall and the upper lock head 120. It should be noted here that the constructed ship lock 10 after reconstruction and expansion is used as the "upper navigation wall" of the new ship lock 30. Therefore, it is necessary to demolish the flood gate in the upper lock head section 120 of the constructed ship lock to ensure uninterrupted navigation along the entire waterway.

In addition, the construction sequence of the third water-retaining and seepage control line 440 and the cutoff buttress 320 can be determined according to the actual need. The third water-retaining and seepage control line 440 can be constructed before the cutoff buttress, or after the cutoff buttress is constructed.

S6. A third water-retaining and seepage control line 440 is added, where the third water-retaining and seepage control line 440 corresponds to the upper lock head section 310 of the new ship lock and the cutoff buttress 320, and extends in the direction perpendicular to the water flow; a river-side end of the third water-retaining and seepage control line is connected to a downstream end of the second water-retaining and seepage control line 430, and a bank-side end of the third water-retaining and seepage control line 440 is located in the bank-side soil body.

It can be understood by those skilled in the art that to construct a closed-loop impervious and water-retaining system, an original water-retaining and seepage control line 40 of the constructed ship lock 10 is moved down to the new ship lock 30. In this step, the third water-retaining and seepage control line 440 is added at the position of the upper lock head section 310 of the new ship lock and the cutoff buttress 320, so that the original water-retaining and seepage control line of the constructed ship lock 10, the first water-retaining and seepage control line 420, the second water-retaining and seepage control line 430 and the third water-retaining and seepage control line 440 can jointly form a new closed-loop water-retaining and seepage control line to jointly undertake the water retaining, waterproof and seepage control line of the new ship lock 30, thereby reducing seepage flow and a seepage pressure, and ensuring the seepage control requirements of the new ship lock 30. As a preferred example, the third water-retaining and seepage control line can be in the form of curtain grouting. A specific construction method of curtain grouting is well known to those skilled in the art and thus will not be described in detail here.

In addition, it should also be noted that the third water-retaining and seepage control line 440 extends in the direction perpendicular to the water flow, so the third water-retaining and seepage control line 440 includes a river-side end and a bank-side end which are opposite to each other.

In the scheme of the present disclosure, on the premise of not damaging an original water-retaining line building during the construction period, firstly, a new ship lock 30 is constructed downstream as a new ship lock water-retaining line building, a constructed lock wall structure is fully utilized, and a water-retaining line of a ship lock junction is innovatively moved down by cutting the bank-side pier structure 180 and adding the first water-retaining and seepage control line 420, the second water-retaining and seepage control line 430 and the third water-retaining and seepage control line 440, thereby ensuring that the normal operation of the constructed junction will not be affected during the construction period. Secondly, by newly constructing the water-retaining line downstream, inertial thinking that a large-scale earth-rock cofferdam project needs to be constructed upstream to reconstruct an existing water-retaining line building is skillfully avoided, thereby ensuring safety during the construction period of the project reconstruction, and greatly saving the project cost. The reconstruction and expansion on the basis of the original ship lock do not require large-scale land acquisition on the side, which may be the only scheme in a canyon area, and can effectively save land and project investment.

As a preferred implementation of the present disclosure, the method further includes the following steps between step S3 and S4.

S31: The river-side pier structure 170 between the upper lock head section 120 of the constructed ship lock and the upper lock head section 310 of the new ship lock is reinforced. It should be understood by those skilled in the art that a stress condition of a lock wall structure of at lock chamber section 130 of the constructed ship lock has changed in in-situ reconstruction and expansion of the ship lock, and the lock wall structure only bears reciprocating water retaining during an operation period before the reconstruction, and does not retain water in most cases. However, as the lock wall at the lock chamber section 130 of the constructed ship lock after reconstruction is used as a permanent water-retaining structure, it is necessary to reinforce the river-side pier structure 170 between the upper lock head section 120 of the constructed ship lock and the upper lock head section 310 of the new ship lock. The way of reinforcement treatment can be set by the those skilled in the art according to the actual needs. As a preferred example, the way of reinforcement treatment may employ the following ways.

S311: A reinforcing retaining wall 160 is constructed on an inner side of the river-side pier structure 170, where the bottom of the reinforcing retaining wall 160 is fastened to a bottom plate 131 of the lock chamber section 130 of the constructed ship lock by implanting an anchoring steel bar 161, a sidewall of the reinforcing retaining wall 160 is fastened to the river-side pier structure 170 by implanting the anchoring steel bar 161, and the second water-retaining and seepage control line 430 is arranged on an inner side of the reinforcing retaining wall 160.

It should be noted that the inner side of the foregoing river-side pier structure 170 refers to one side, close to the bank-side pier structure 180, of the river-side pier structure 170, that is, the side wall located in the waterway. By constructing the reinforcing retaining wall 160 on the inner side of the river-side pier structure 170 and taking the reinforcing retaining wall 160 and the river-side pier structure 170 as a whole structure to serve as a permanent water-retaining structure after reconstruction, the structural strength of the river-side pier structure 170 of the constructed ship lock 10 can be greatly enhanced.

Further, after step S311, the method further includes the following steps.

S312: A prestressed anchor cable 162 is implanted into the reinforcing retaining wall 160, where the prestressed anchor cable 162 penetrates through the reinforcing retaining wall 160 downwards from the top of the reinforcing retaining wall 160 and is fastened to the bottom plate 131 of the lock chamber section 130 of the constructed ship lock. To further improve the structural strength and integrity, the embodiment of the present disclosure also includes implanting the prestressed anchor cable 162 into the reinforcing retaining wall 160, thereby firmly connecting the reinforcing retaining wall 160 to the river-side pier structure 170 of the constructed ship lock 10 and the bottom plate 131 of the lock chamber section 131, please referring to FIG. 8 and FIG. 9 for details.

As a preferred implementation of the present disclosure, "reconstructing an upper navigation wall section and the upper lock head section 120 of the constructed ship lock 10" in step S5 specifically includes the following steps.

S51: The upper lock head section 120 of the constructed ship lock and a bank-side part structure of the upper navigation wall section of the constructed ship lock 10 are cut off upstream in turn along an inner wall of the bank-side pier structure 180, thereby enabling a navigable width of the constructed ship lock 10 to match an entrance width of the new ship lock 30.

S52: A river-side part structure of the upper lock head section 120 of the constructed ship lock is cut off upstream along an inner wall of the river-side pier structure 170, thereby connecting the upper lock head section 120 of the constructed ship lock to the reinforcing retaining wall 160.

Figure 5:
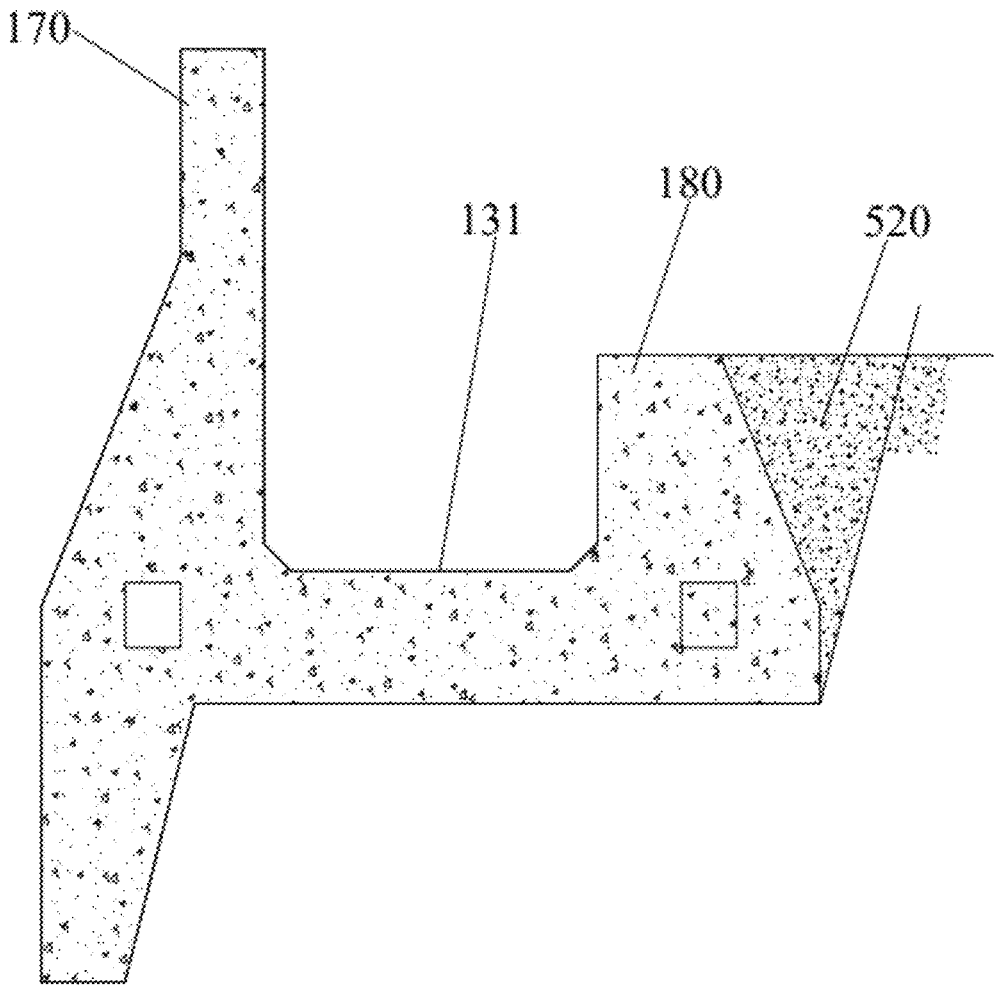
FIG. 5 is a sectional diagram in A-A direction in FIG. 4.
Figure 6:
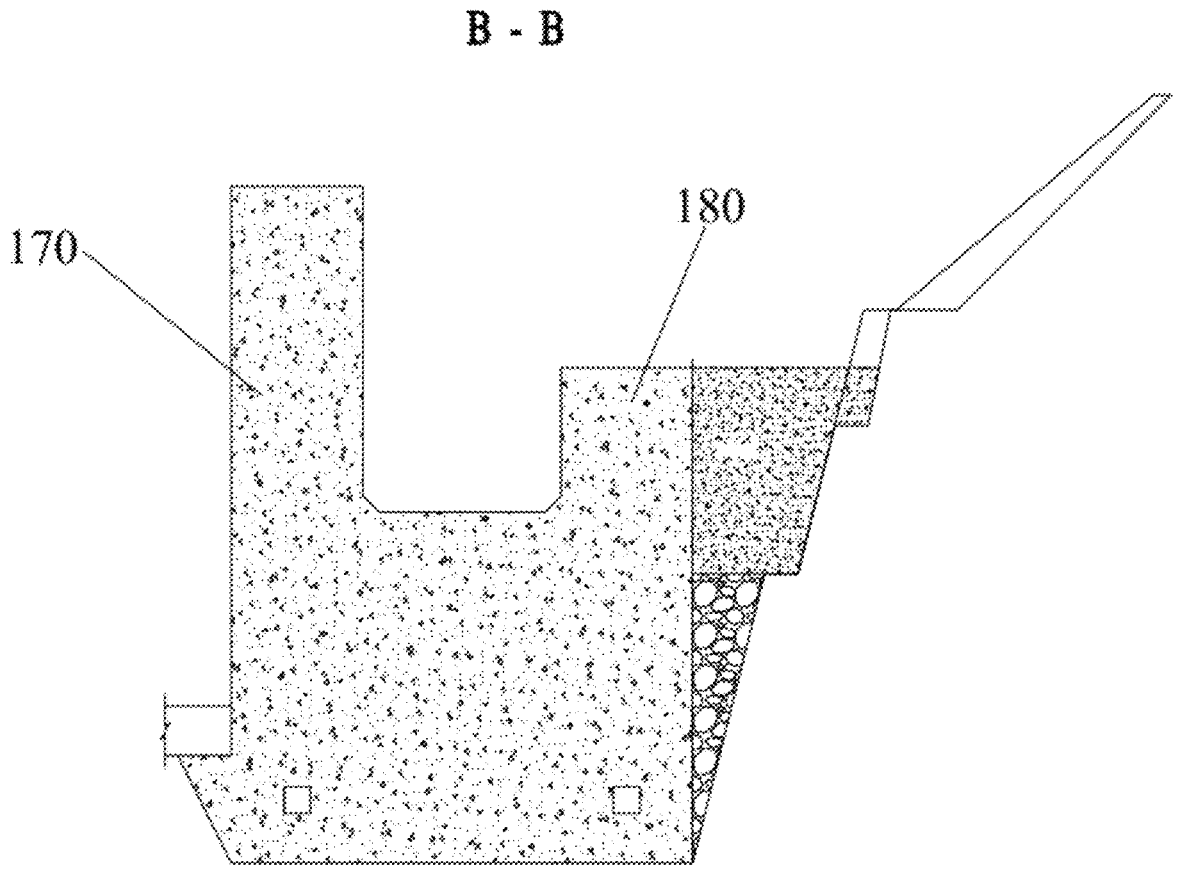
FIG. 6 is a sectional diagram in B-B direction in FIG. 4.
Figure 7:
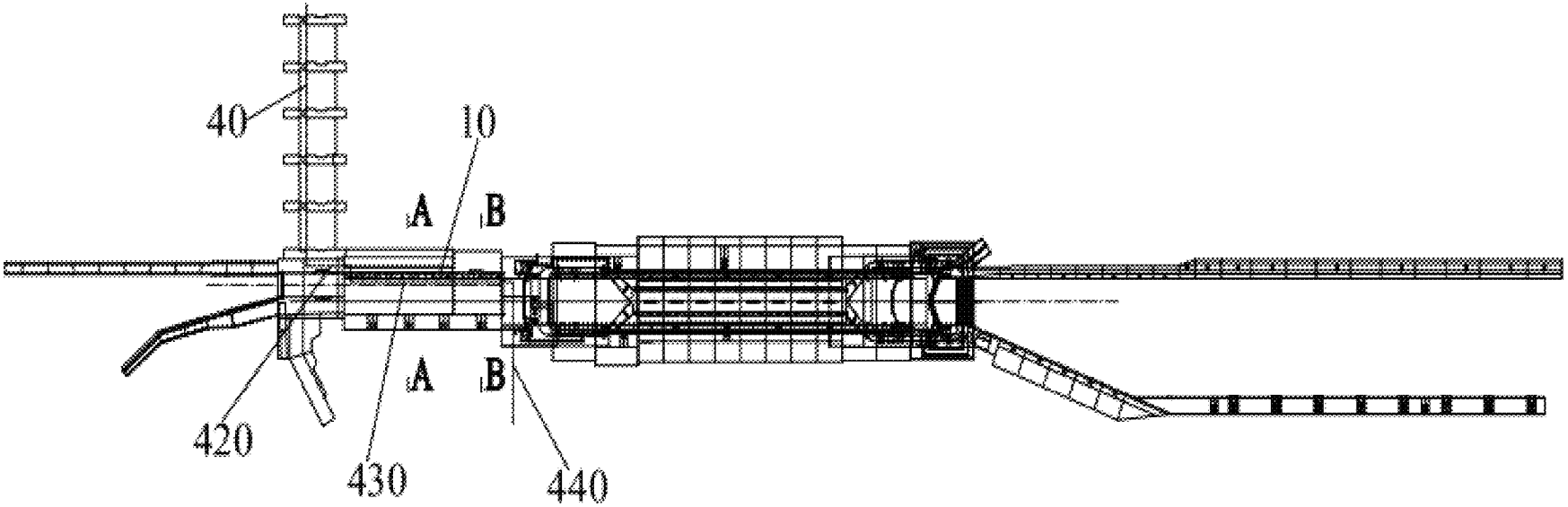
FIG. 7 is a diagram of a structure after a water-retaining and seepage control line is constructed according to an embodiment of the present disclosure.
Figure 8:
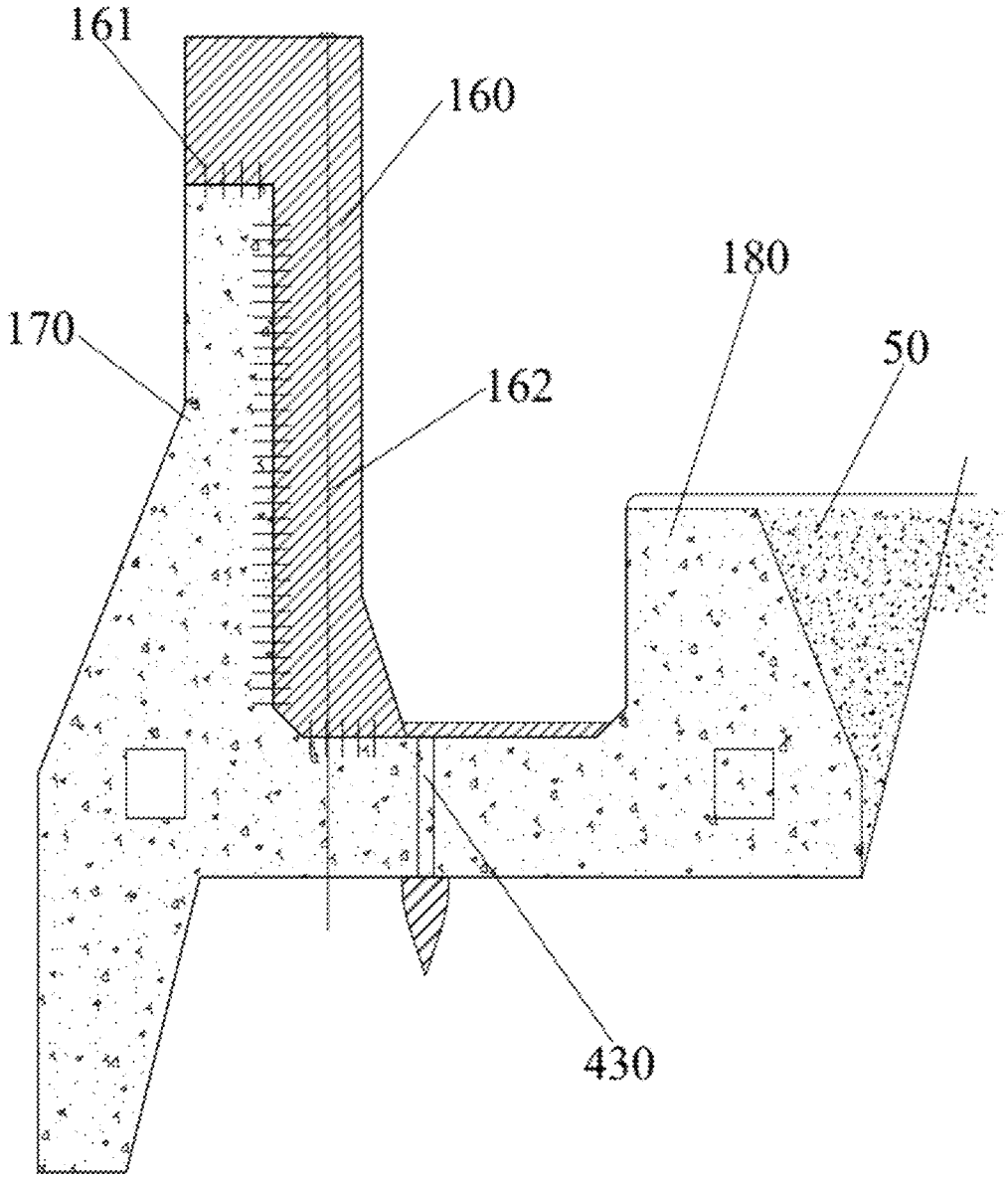
FIG. 8 is a sectional diagram in A-A direction in FIG. 7.
Figure 9:
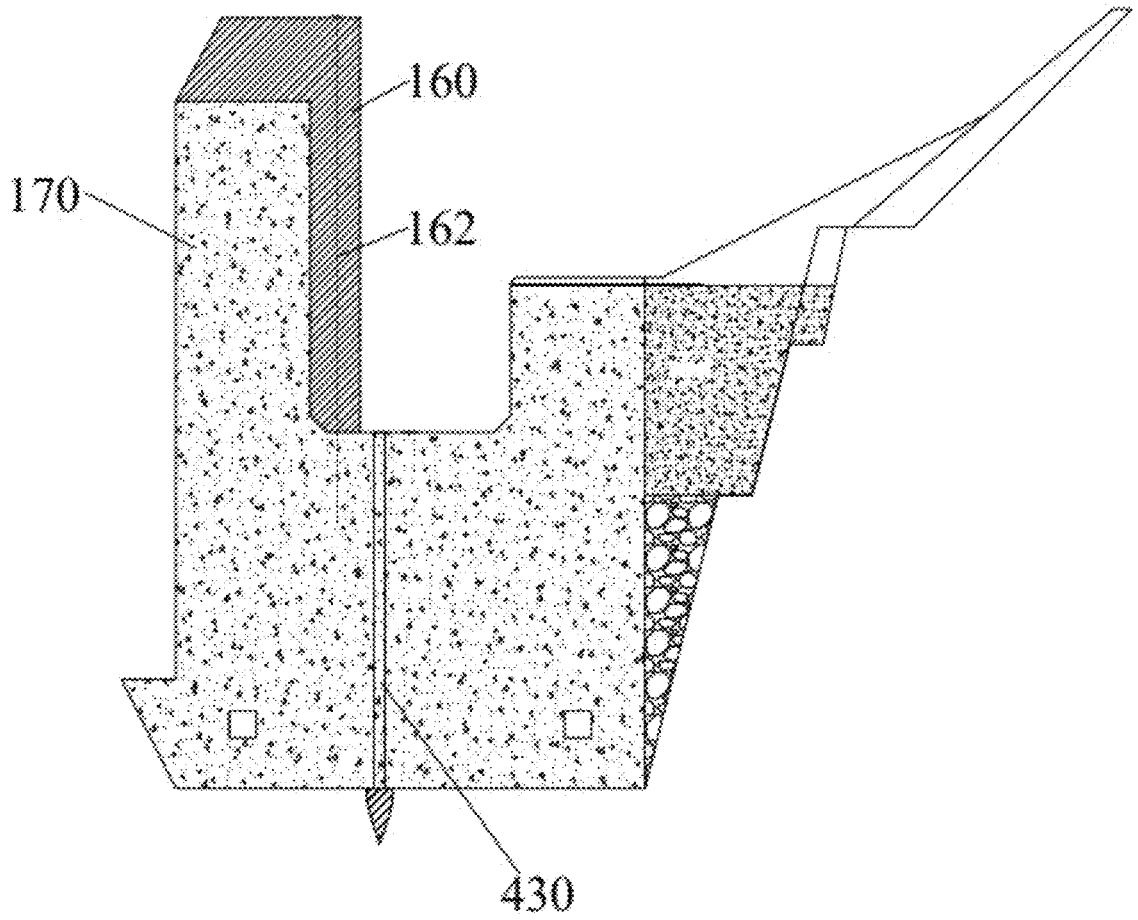
FIG. 9 is a sectional diagram in B-B direction in FIG. 7.
Figure 10:
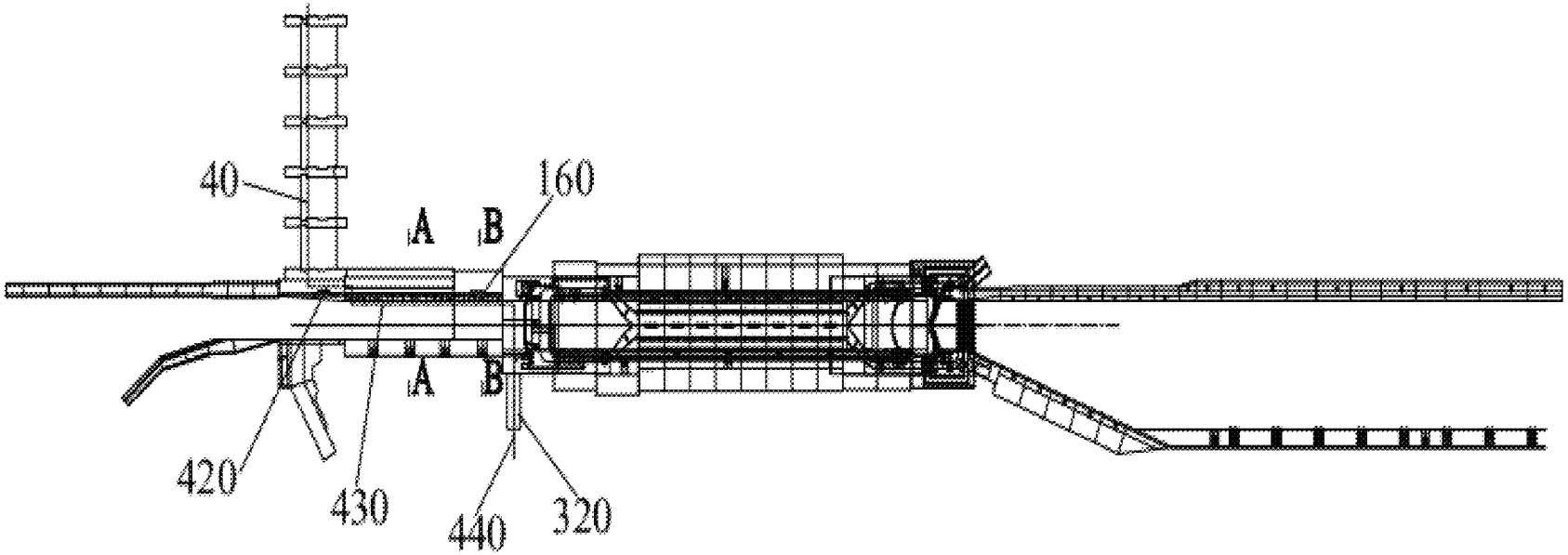
FIG. 10 is a diagram of an overall structure after reconstruction and expansion according to an embodiment of the present disclosure.

Please referring to FIG. 5 and FIG. 8, the parts specifically cut off in step S51 are mainly partial structures of the upper navigation wall close to the bank and the upper lock head close to the bank of the constructed ship lock 10, thereby enabling the bank sides of the upper navigation wall and the upper lock head of the constructed ship lock 10 to match the bank-side pier structure 180.

In addition, the parts specifically cut off in step S52 are mainly partial structures, close to the river side, of the upper navigation wall and the upper lock head. On the contrary, if this step is not taken, passing ships may bump into the side of the reinforcing retaining wall 160.

As a preferred implementation of the present disclosure, the method further includes the following steps between step S3 and S4.

S32: An inner backfill between the bank-side pier structure and a river embankment is replaced with C20 concrete 50 and filled to the first preset elevation.

It should be noted that the internal backfill between the bank-side pier structure 180 of the constructed ship lock 10 and the river embankment is cobblestones and earth stones. Before reconstruction and expansion, there is no river water immersion and scouring on the internal backfill most of the time. After reconstruction and expansion, this part of the internal backfill area will be used as a reservoir area/water storage area, and the river water is about to submerge this part. Based on this, C20 concrete 50 is used for replacement in this embodiment, thereby reducing the damage of water flow to the river embankment and improving the overall structural strength.

As a preferred example, a thickness of the reinforcing retaining wall 160 ranges from 2.8 m to 3.2 m, and a height of the reinforcing retaining wall is 4-6 m higher than the top of the river-side pier structure 170. It may be understood that the thickness of the reinforcing retaining wall 160 and a height difference between the reinforcing retaining wall 160 and the river-side pier structure 170 can also be set by those skilled in the art according to actual needs. The thickness of the reinforcing wall refers to a dimension in the direction perpendicular to the water flow. Further, after step S3, the method further includes the following steps:

pouring the bank-side pier structure 180 to a second preset elevation after implanting the steel bar into the top thereof, thereby leveling a top surface of the bank-side pier structure 180. It may be understood by those skilled in the art that after the bank-side pier structure 180 between the upper lock head section 120 of the constructed ship lock and the upper lock head section 310 of the new ship lock is cut to the first preset elevation, the top of the bank-side pier structure 180 is uneven at this time, and then the bank-side pier structure is poured to the second preset elevation after the steel bar is implanted, thereby leveling the top surface of the bank-side pier structure 180. As a specific example, a height difference between the second preset elevation and the first preset elevation is set at 0.5 m.

The foregoing is only a preferred embodiment of the present disclosure, and is not intended to limit the patent scope of the present disclosure. Any equivalent structure or equivalent flow transformation made by using the contents of the specification and accompanying drawings of the present disclosure, or directly or indirectly used in other related technical fields, are equally included in the patent protection scope of the present disclosure.

What is claimed is:

1. A construction method for reconstructing and expanding a ship lock in situ, comprising the following steps:

S1, taking a flood gate in an upper lock head section of a constructed ship lock as a water-retaining cofferdam during a construction period, cutting off a remaining part of the constructed ship lock downstream from a target cutting surface located in a lock chamber section of the constructed ship lock, wherein the target cutting surface is at a preset distance from the flood gate, and the target cutting surface is perpendicular to an extension direction of the constructed ship lock;

S2, constructing a new ship lock downstream from the target cutting surface, wherein an upper lock head section of the new ship lock is connected to the target cutting surface, and an entrance width of the new ship lock is larger than that of the constructed ship lock;

S3, cutting a bank-side pier structure between the upper lock head section of the constructed ship lock and the upper lock head section of the new ship lock to a first preset elevation, wherein a difference between a lowest design navigable water level of the constructed ship lock and the first preset elevation is not less than the minimum water depth required for vessel navigation;

S4, adding a first water-retaining and seepage control line and a second water-retaining and seepage control line, wherein the first water-retaining and seepage control line corresponds to the upper lock head section of the constructed ship lock, the second water-retaining and seepage control line is located between the upper lock head section of the constructed ship lock and the upper lock head section of the new ship lock, an upstream end of the first water-retaining and seepage control line is connected to an original water-retaining and seepage control line of the constructed ship lock, and an upstream end of the second water-retaining and seepage control line is connected to a downstream end of the first water-retaining and seepage control line;

S5, constructing a cutoff buttress at a position corresponding to the upper lock head section of the new ship lock, and reconstructing an upper navigation wall section and the upper lock head section of the constructed ship lock to enable a navigable width of the constructed ship lock to match the entrance width of the new ship lock, wherein the cutoff buttress is inserted into a bank-side soil body from the upper lock head section of the new ship lock in a direction perpendicular to a water flow; and S6, adding a third water-retaining and seepage control line, wherein the third water-retaining and seepage control line corresponds to the upper lock head section of the new ship lock and the cutoff buttress and extends in the direction perpendicular to the water flow, a river-side end of the third water-retaining and seepage control line is connected to a downstream end of the second water-retaining and seepage control line, and a bank-side end of the third water-retaining and seepage control line is located in the bank-side soil body.

2. The construction method for reconstructing and expanding a ship lock in situ according to claim 1, wherein the method further comprises the following steps between step S3 and step S4:

S31: reinforcing a river-side pier structure between the upper lock head section of the constructed ship lock and the upper lock head section of the new ship lock.

3. The construction method for reconstructing and expanding a ship lock in situ according to claim 2, wherein the S31 specifically comprises the following steps:

S311: constructing a reinforcing retaining wall on an inner side of the river-side pier structure, wherein the bottom of the reinforcing retaining wall is fastened to a bottom plate of the lock chamber section of the constructed ship lock by implanting an anchoring steel bar, a sidewall of the reinforcing retaining wall is fastened to the river-side pier structure by implanting the anchoring steel bar, and the second water-retaining and seepage control line is arranged on an inner side of the reinforcing retaining wall.

4. The construction method for reconstructing and expanding a ship lock in situ according to claim 3, wherein after step S311, the method further comprises the following steps:

S312: implanting a prestressed anchor cable into the reinforcing retaining wall, wherein the prestressed anchor cable penetrates through the reinforcing retaining wall downwards from the top thereof and is fastened to the bottom plate of the lock chamber section of the constructed ship lock.

5. The construction method for reconstructing and expanding a ship lock in situ according to claim 3, wherein the reconstructing an upper navigation wall section and the upper lock head section of the constructed ship lock in step S5 specifically comprises the following steps:

S51: sequentially cutting off the upper lock head section of the constructed ship lock and a bank-side part structure of the upper navigation wall section of the constructed ship lock upstream along an inner wall of the bank-side pier structure, thereby enabling the navigable width of the constructed ship lock to match the entrance width of the new ship lock; and S52: cutting off a river-side part structure of the upper lock head section of the constructed ship lock upstream along an inner wall of the river-side pier structure, thereby connecting the upper lock head section of the constructed ship lock to the reinforcing retaining wall.

6. The construction method for reconstructing and expanding a ship lock in situ according to claim 3, wherein a thickness of the reinforcing retaining wall ranges from 2.8 m to 3.2 m, and a height of the reinforcing retaining wall is 4-6 m higher than the top of the river-side pier structure.

7. The construction method for reconstructing and expanding a ship lock in situ according to claim 1, wherein the method further comprises the following steps between step S3 and step S4:

S32: replacing and filling an internal backfill between the bank-side pier structure and a river embankment to the first preset elevation with C20 concrete.

8. The construction method for reconstructing and expanding a ship lock in situ according to claim 1, wherein after step S3, the method further comprises the following steps:

pouring the bank-side pier structure to a second preset elevation after implanting the steel bar into the top thereof, thereby leveling a top surface of the bank-side pier structure.

* * * * *